US007269373B2

(12) United States Patent
Kim et al.

(10) Patent No.: US 7,269,373 B2
(45) **Date of Patent: *Sep. 11, 2007**

(54) LIQUID-TYPE IMAGE FORMING APPARATUS AND A METHOD FOR CONTROLLING THE SAME

(75) Inventors: Sung-dae Kim, Suwon-si (KR); Hyun-seong Shin, Suwon-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 0 days.

This patent is subject to a terminal disclaimer.

(21) Appl. No.: 11/154,527

(22) Filed: Jun. 17, 2005

(65) Prior Publication Data

US 2006/0056874 A1 Mar. 16, 2006

(30) Foreign Application Priority Data

Sep. 16, 2004 (KR) ..... 10-2004-0074161

(51) Int. Cl.
*G03G 21/20* (2006.01)

(52) U.S. Cl. ..... 399/93

(58) Field of Classification Search ..... 399/91–93, 399/44

See application file for complete search history.

(56) References Cited

U.S. PATENT DOCUMENTS 4,415,533 A 11/1983 Kurotori
4,760,423 A 7/1988 Holtje
7,079,784 B2 * 7/2006 Kim et al. ..... 399/93
2005/0152712 A1 7/2005 Kim

FOREIGN PATENT DOCUMENTS

| | | |
|---|---|---|
| JP | 57-104968 | 6/1982 |
| JP | 2001-334723 | 12/2001 |
| JP | 2003107973 | 11/2003 |
| KR | 1020010028557 | 4/2001 |
| KR | 10-2001-062163 | 7/2001 |
| KR | 10-2004-022944 | 3/2004 |

* cited by examiner

*Primary Examiner*—David M. Gray
*Assistant Examiner*—Ryan Gleitz
(74) *Attorney, Agent, or Firm*—Roylance, Abrams, Berdo & Goodman, L.L.P.

(57) ABSTRACT

A liquid-type image forming apparatus has a printing engine including a developing unit and a transferring unit and a fixing member. The apparatus includes a carrier vapor-processing device having an oxidation catalyst carrier that accelerates oxidation of carrier vapors occurring in the fixing member. A temperature sensor detects a temperature of the oxidation catalyst carrier. A control member compares information measured by the temperature sensor, and compares the information with predetermined reference values. The printing operation of the printing engine is controlled according to the result of the comparison.

12 Claims, 6 Drawing Sheets

LIQUID-TYPE IMAGE FORMING APPARATUS AND A METHOD FOR CONTROLLING THE SAME

CROSS-REFERENCE TO RELATED APPLICATIONS

This application claims the benefit under 35 U.S.C. § 119(a) of Korean Patent Application No. 2004-74161, filed on Sep. 16, 2004, the entire contents of which are hereby incorporated by reference.

BACKGROUND OF THE INVENTION

1. Field of the Invention

The present invention relates to a liquid-type image forming apparatus having a carrier vapor-processing device for processing carrier vapors occurring when a printing operating is performed, and a method of controlling the apparatus.

2. Description of the Related Art

Generally, a liquid-type image forming apparatus forms an electrostatic latent image by illuminating a laser beam to an image carrying medium, such as a photosensitive drum. A visible image formed by attaching a developer to the electrostatic latent image is transferred to a sheet so that a desired image can be obtained. Such an image forming apparatus is suitable for color printing because a clearer image can be obtained compared to a dry-type image forming apparatus using a powder toner.

FIG. 1 schematically shows a structure of a conventional liquid-type image forming apparatus.

As shown in FIG. 1, the conventional liquid-type electrophotographic image forming apparatus 10 includes a main body 11 of the apparatus, a plurality of photosensitive drums 12, 13, 14 and 15 on which electrostatic latent images are formed, a plurality of electrification devices 22, 23, 24 and 25 for electrifying each of the photosensitive drums 12, 13, 14 and 15 to a predetermined electric potential, a plurality of exposure devices 32, 33, 34 and 35 for illuminating a laser beam to each of the electrified photosensitive drums 12, 13, 14 and 15, a plurality of developing units 52, 53, 54 and 55 for supplying a developer to each of the photosensitive drums 12, 13, 14 and 15 for forming visible images, a plurality of first transfer rollers 62, 63, 64 and 65 for transferring the visible images formed on each of the photosensitive drums 12, 13, 14 and 15 to a transfer belt 60, a second transfer roller 66 transferring a final image that is formed on the transfer belt 60 by the visible images being superposed thereon to a supplied paper P, and a fixing member 70 for fixing the final image on the paper P by applying heat and pressure.

The plurality of developing units 52, 53, 54 and 55 respectively store developers of different colors, and supply the color developers to each of the photosensitive drums 12, 13, 14 and 15. The developer consists of ink having toners dispersed therein and a liquid carrier such as norpar. The norpar is a hydrocarbon solvent that is a mixture of $C_{10}H_{22}$, $C_{11}H_{24}$, $C_{12}H_{26}$ and $C_{13}H_{28}$. The developers attached to each of the photosensitive drums 12, 13, 14 and 15 for forming the visible images are transferred to the transfer belt 60 and superposed thereon. The final image formed by the plurality of visible images superposed on the transfer belt 60 is transferred to the supplied paper P. When the paper P passes through the fixing member 70, the ink component of the developer is fixed to the paper P. The liquid carrier of the developer is evaporated to an inflammable hydrocarbon gas, such as methane ($CH_4$), due to the high temperature.

The inflammable hydrocarbon gas, which is classified as a volatile organic compound (VOC), pollutes the environment and emits offensive smells when being discharged. Due to such problems, diverse methods for removing the inflammable hydrocarbon gas have been currently provided.

The currently known methods of removing the inflammable hydrocarbon gas includes a filtering method of physically removing the gas component using a carbon filter, such as activated carbon, a direct combustion method of combusting the gas component at an ignition temperature (600~800° C.), and an oxidation catalyst method of combusting the gas component at a relatively low temperature (150~400° C.) using a catalyst and thus oxidizing it into water and carbon dioxide.

In the filter method, the carbon filter has no capability of decomposing the carrier collected therein. Accordingly, the filter method has a disadvantage that when the carrier is collected beyond a predetermined amount, the saturated carbon filter needs to be replaced. The direct combustion method has a safety problem due to the high temperature.

Owing to the above-mentioned problems, the oxidation catalyst method is mainly used in recent years to remove the carrier vapor in the liquid-type electrophotographic image forming apparatus. Additionally, there is an increased interest in improving the efficiency of oxidation of the carrier vapors.

Accordingly, a need exists for an improved liquid-type image forming apparatus that efficiently processes carrier vapors occurring during printing operations.

SUMMARY OF THE INVENTION

Accordingly, an aspect of the present invention is a liquid-type image forming apparatus capable of processing carrier vapors using an oxidation catalyst method, and a method of controlling the apparatus.

The above object of the present invention is substantially realized by providing a liquid-type image forming apparatus having a printing engine including a developing unit and a transfer unit and a fixing member. The liquid-type image forming apparatus includes a carrier vapor-processing device having an oxidation catalyst carrier accelerating an oxidation of carrier vapors occurring in the fixing member. A temperature sensor detects a temperature of the oxidation catalyst carrier. A control member compares receiving information measured from the temperature sensor, compares the information with predetermined reference values, and controls a printing operation of the printing engine according to the comparison results.

Preferably, the control member may interrupt the printing operation of the printing engine when the measured temperature exceeds a maximum value of the reference values during a printing mode.

Additionally, the control member may preferably control to re-execute the printing operation of the printing engine when the measured temperature is below the minimum value of the reference values when the printing mode was interrupted.

Additionally, the carrier vapor-processing device may preferably include a duct for sucking the carrier vapors from the fixing member and having the oxidation catalyst carrier mounted therein. A fan is mounted to the duct. A heater is mounted to the duct to heat the carrier vapors entering the oxidation catalyst carrier.

Further, the control member may preferably control on/off driving of the heater according to the measured temperature of the temperature sensor.

Additionally, the control member may preferably control on/off driving of the fan according to the measured temperature of the temperature sensor.

Further, in accordance with another aspect of the present invention, a method of controlling a liquid-type image forming apparatus of the invention includes steps of processing carrier vapors generated from a fixing member during a printing operation using an oxidation catalyst. A temperature of the oxidation catalyst is measured. The oxidation catalyst is cooled when the measured temperature is above a predetermined maximum value.

Additionally, the cooling step may preferably include a step of interrupting the printing operation.

Further, the cooling step may preferably include a step of turning off a heater that heats the carrier vapors entering the oxidation catalyst.

Additionally, the cooling step may preferably proceed until when the temperature measured in the temperature sensor is below a predetermined minimum value.

Further, the minimum value may be between approximately 100° C. and 250° C.

In addition, the maximum value may be between approximately 450° C. and 600° C.

Further, the cooling step may proceed during a predetermined standard time.

Other objects, advantages and salient features of the invention will become apparent from the following detailed description, which, taken in conjunction with the annexed drawings, discloses preferred embodiments of the invention.

BRIEF DESCRIPTION OF THE DRAWINGS

The above aspects and features of the present invention will be more apparent by describing certain embodiments of the present invention with reference to the accompanying drawings, in which.

Throughout the drawings, like reference numerals will be understood to refer to like parts, components and structures.

DETAILED DESCRIPTION OF EXEMPLARY EMBODIMENTS

Hereinafter, exemplary embodiments of the present invention will be described in detail with reference to the accompanying drawing figures.

The matters defined in the description, such as a detailed construction and elements thereof, are provided to assist in a comprehensive understanding of the exemplary embodiments of the present invention. Thus, it is apparent that the present invention may be carried out without those defined matters. Also, well-known functions or constructions are omitted to provide a clear and concise description of exemplary embodiments of the present invention.

Figure 1:
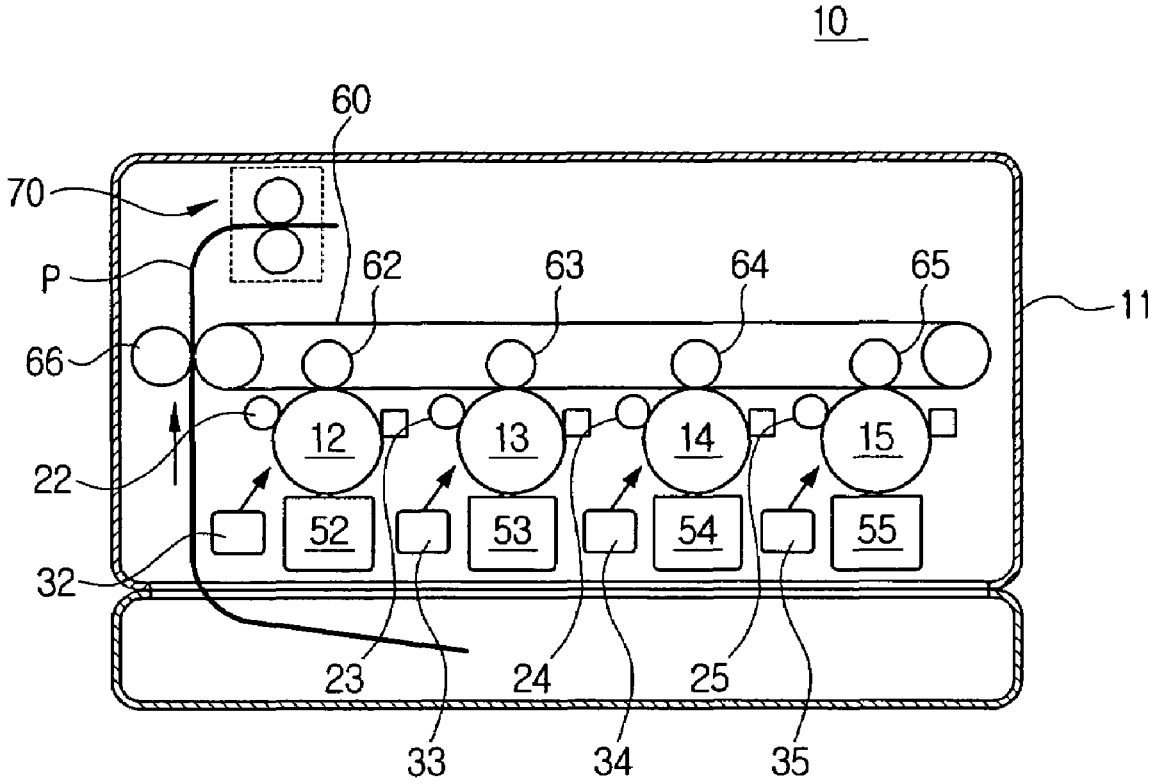
FIG. 1 (PRIOR ART)
FIG. 1 schematically shows a structure of a conventional liquid-type image forming apparatus.
Figure 2:
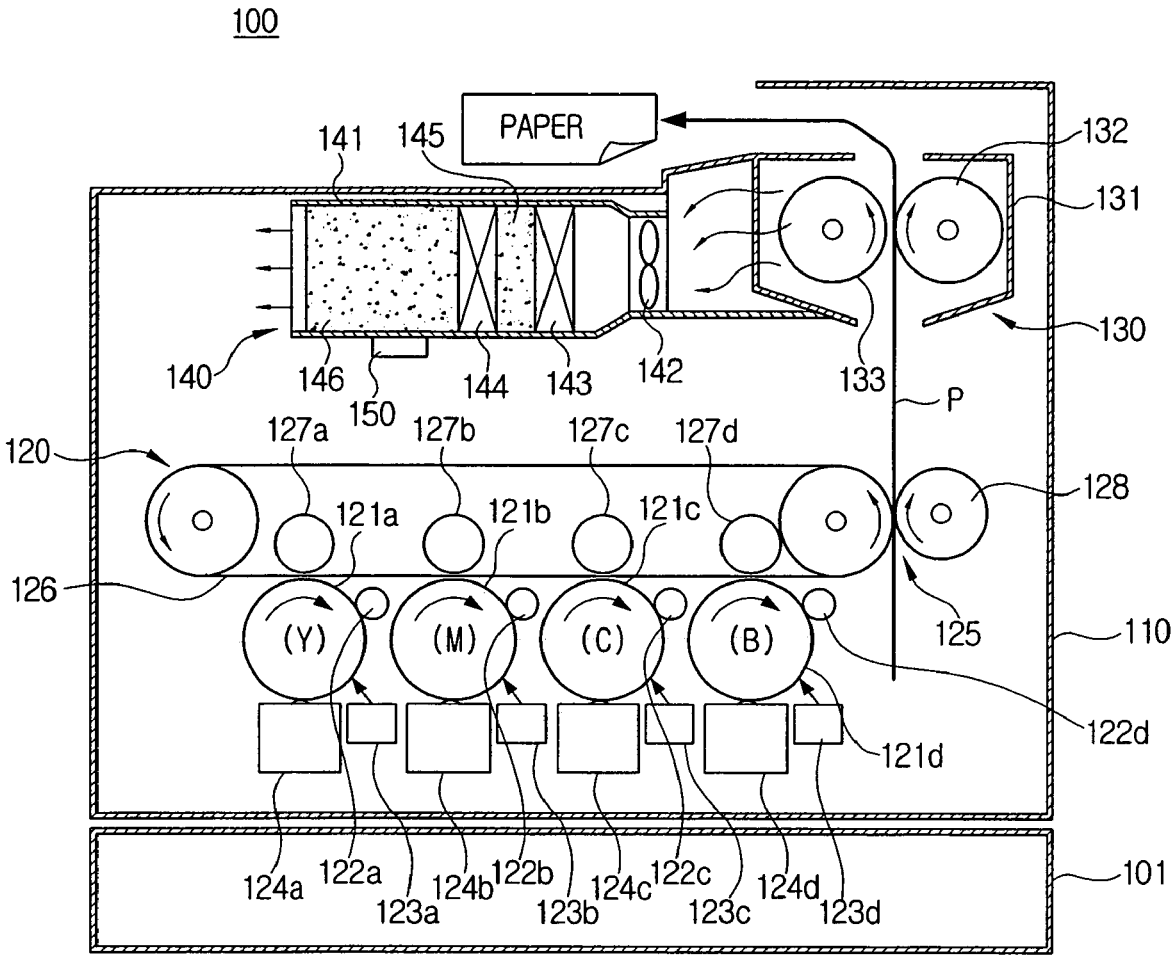
FIG. 2 is a schematic view showing a structure of a liquid-type image forming apparatus according to an exemplary embodiment of the present invention.
Figure 3:
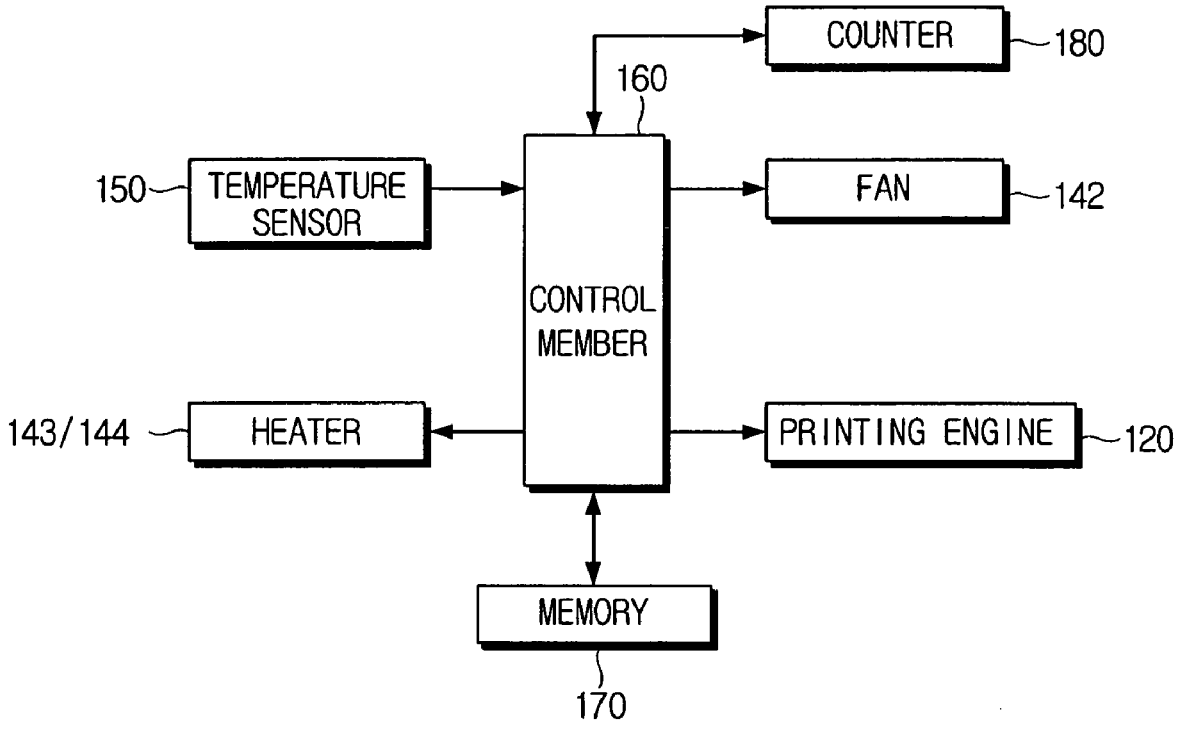
FIG. 3 is block diagram illustrating a structure of a liquid-type image forming apparatus according to an exemplary embodiment of the present invention.

As shown in FIGS. 2 and 3, a liquid-type image forming apparatus 100 according to an exemplary embodiment of the present invention includes a main body 110 constituting an exterior of the image forming apparatus, a printing engine 120 for forming a visible image with a developer and transferring the visible image to a supplied printing medium P, a fixing member 130 for fusing the visible image transferred to the printing medium P on the printing medium P, a carrier vapor-processing device 140 for purifying the carrier vapors generated from the fixing member 130, a temperature sensor 150, and a control member 160.

A paper supply unit 101 for providing the printing medium P to the printing engine 120 is disposed at a lower part of the main body 110.

The printing engine 120 includes photosensitive drums 121*a*, 121*b*, 121*c* and 121*d* as image carrying medium on which electrostatic latent images are formed; electrification devices 122*a*, 122*b*, 122*c* and 122*d*; exposure devices 123*a*, 123*b*, 123*c* and 123*d*; developing units 124*a*, 124*b*, 124*c* and 124*d*; and a transfer unit 125.

The electrification devices 122*a*, 122*b*, 122*c* and 122*d* electrify surfaces of each of the photosensitive drums 121*a*, 121*b*, 121*c* and 121*d* to a predetermined electric potential, thereby enabling a condition for forming the electrostatic latent images on the surfaces of each of the photosensitive drums 121*a*, 121*b*, 121*c* and 121*d*.

The exposure devices 123*a*, 123*b*, 123*c* and 123*d* generate a laser beam and scan the laser beam on the surfaces of the respective photosensitive drums 121*a*, 121*b*, 121*c* and 121*d* electrified to the predetermined electric potential by the electrification devices 122*a*, 122*b*, 122*c* and 122*d*. An electrostatic latent image if formed on the surface of each of the photosensitive drums 121*a*, 121*b*, 121*c* and 121*d* illuminated with the laser beam due to a difference of the electric potentials.

The developing units 124*a*, 124*b*, 124*c* and 124*d* supply developers to each of the photosensitive drums 121*a*, 121*b*, 121*c* and 121*d*. The developing units 124*a*, 124*b*, 124*c* and 124*d* respectively store the developers of different colors, such as yellow, magenta, cyan and black, and attach the developers to the electrostatic latent images formed on the surfaces of each of the photosensitive drums 121*a*, 121*b*, 121*c* and 121*d*. The developers attached to the electrostatic latent images form visible images on the surfaces of each of the photosensitive drums 121*a*, 121*b*, 121*c* and 121*d*. The developer includes an ink having toners included therein and a liquid carrier such as norpar. The norpar is a hydrocarbon solvent, which is a mixture of $C_{10}H_{22}$, $C_{11}H_{24}$, $C_{12}H_{26}$ and $C_{13}H_{28}$, and is evaporated into an inflammable hydrocarbon gas, such as methane ($CH_4$).

The transfer unit 125 is preferably of a caterpillar form and includes a transfer belt 126 traveling abuttingly on the photosensitive drums 121*a*, 121*b*, 121*c* and 121*d*; a plurality of first transfer rollers 127*a*, 127*b*, 127*c* and 127*d* transferring the visible images formed on each of photosensitive drums 121*a*, 121*b*, 121*c* and 121*d* to the transfer belt 126; and a second transfer roller 128 transferring a final image that is formed on the transfer belt 126 by the visible images being superposed thereon to the supplied printing medium P.

The printing engine 120 having the above structure may have a structure sealed hermetically to an exterior by the main body 110 or by a dedicated shielding chamber (not shown).

The fixing member 130 applies heat and pressure to the printing medium P having the color images transferred thereto, thereby evaporating the carrier of the developers and fixing the ink to the printing medium P. The fixing member 130 includes a heating roller 132 mounted in a housing 131 to generate high temperature, and a press roller 133 mounted in the housing 131 to rotate in contact with the heating roller 132. The heating roller 132 generates the high temperature with a heating element attached thereto, such as a heating lamp or a heating wire. Accordingly, when the transferred image passes through the fixing member 130, the liquid carrier, such as norpar, is instantaneously evaporated due to the high temperature. The vaporized carrier contains aqueous vapor, which is originally contained in the printing medium P, such as paper, and the norpar vapor. Although the fixing member 130 may have diverse structures according to exemplary embodiments alternative to the above-mentioned structure, it has the same function of fixing the printing medium P with temperature and pressure.

Figure 4:
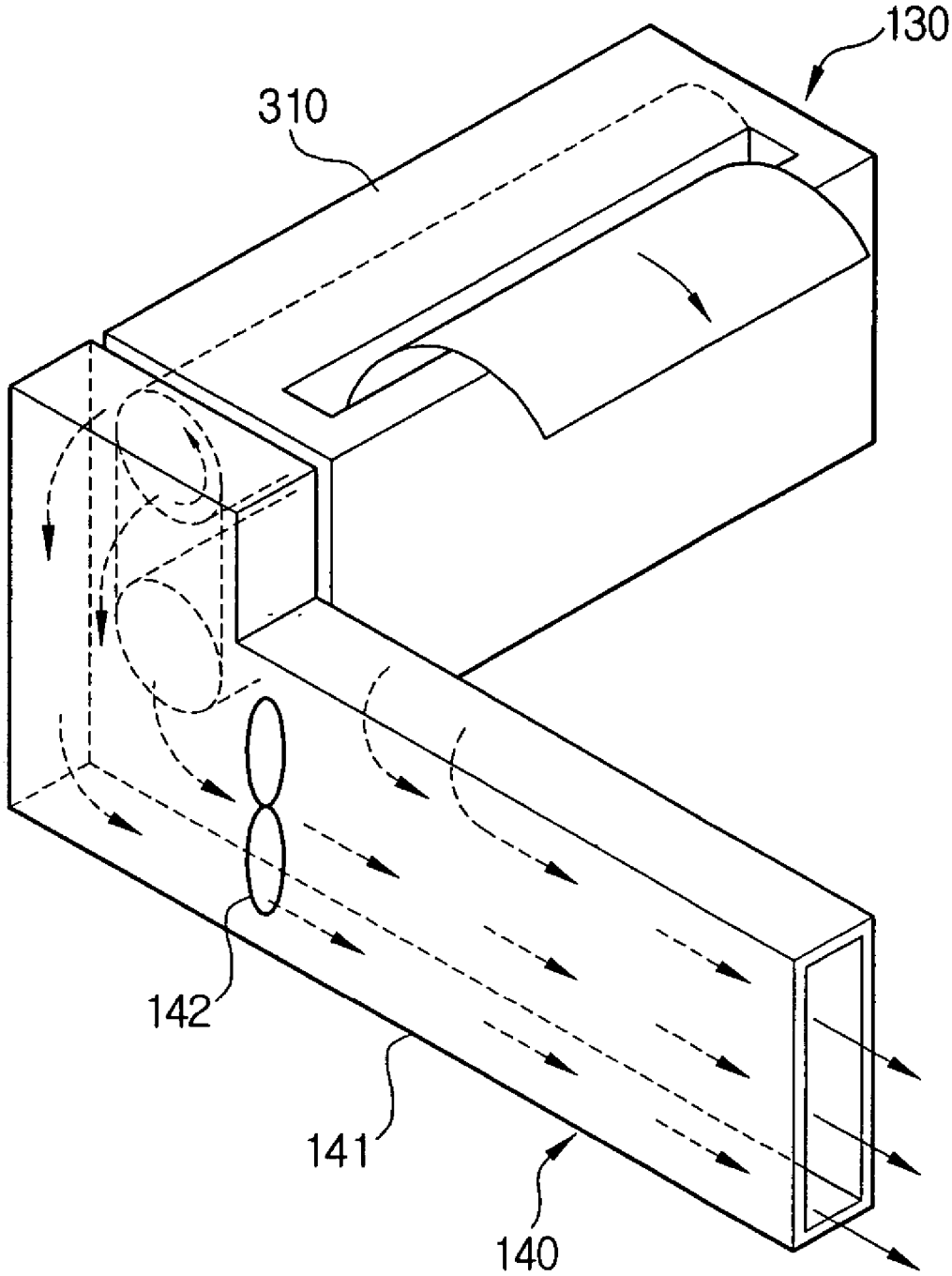
FIG. 4 is a schematic perspective view of a carrier vapor-processing device of FIG. 2.

The carrier vapor-processing device 140 is provided to purify the carrier vapors generated by the fixing member 130, as shown in FIGS. 2 and 4. The carrier vapor-processing device 140 includes a duct 141 for guiding discharge of the carrier vapors generated by the fixing member 130, a fan 142 for forcibly drawing the carrier vapor into the duct 141, heaters 143 and 144 for heating and evaporating liquid remaining in the drawn-in carrier vapor, a zeolite 145 provided between the heaters 143 and 144, and an oxidation catalyst carrier 146 including an oxidation catalyst to accelerate oxidation of the heated carrier vapor.

One end of the duct 141 is preferably connected to a side of the housing 131 of the fixing member 130. The duct 141 guides movement of the carrier vapors generated by the fixing member 130 and discharges the purified vapor to an exterior. A shape and a size of the duct 141 may be diversely embodied depending on a size and a design of the image forming apparatus.

The fan 142 is mounted in the duct 141. The fan 142 forcibly draws in the carrier vapors generated by the fixing member 130 and delivers the vapors to the oxidation catalyst carrier 146.

The heaters 143 and 144 are provided to pre-heat the carrier vapors entering the oxidation catalyst carrier 146. The zeolite 145 provided between the heaters 143 and 144 is an optical material for absorbing the carrier vapors passed through a first heater 143 that have not yet been evaporated and then discharging the carrier vapors into the post-heater 144 as they are evaporated.

Additionally, the heater 144 has a function of pre-heating the oxidation catalyst of the oxidation catalyst carrier 146. Since the oxidation catalyst includes a material that actively proceeds with an oxidation reaction of the carrier vapor at temperatures between about 180° C. and 400° C., the oxidation catalyst carrier 146 is pre-heated at an early stage of the printing.

The oxidation catalyst carrier 146 is coated with an oxidation catalyst, such as platinum (Pt) and palladium (Pd), so that it is activated at about 200° C. and thus accelerates the oxidation reaction in which the carrier vapor, which is an inflammable hydrocarbon gas, is decomposed into water and carbon dioxide. Thus, a proper temperature of the oxidation may be different depending on the oxidation catalyst used. Generally, the oxidation catalyst may be subject to the oxidation reaction at a temperature between about 180° C. and 400° C. The oxidation catalyst exhibits a phenomenon of high temperature damage when it reaches a temperature of about 550° C. Therefore, when it is above about 450~600° C. of a high temperature limit, the oxidation catalyst is cooled by interrupting the printing operation.

Additionally, since the oxidation catalyst cannot proceed with the oxidation reaction according to a kind of the oxidation catalyst when a temperature is lowered to about 100~250° C. or less, the oxidation catalyst carrier 146 should be heated.

The temperature sensor 150 is provided to sense a temperature of the oxidation catalyst of the oxidation catalyst carrier 146 and mounted to the exterior of the oxidation catalyst carrier 146. The temperature sensor 150 may be a thermistor or a thermocouple.

The control member 160 controls a driving of the printing engine 120 so that it controls a general printing process, such as warming up and printing operation and printing interruption processes. Additionally, the operation of the carrier vapor-processing device 140 is also controlled by the control member 160. The control member 160 receives information measured in the temperature sensor 150 and compares the measured information with the high temperature limit (about 450° C.~600° C.). Then, the control member 160 controls whether the printing operation of the printing engine 120 is interrupted or not and the on/off operations of the heaters 143 and 144 according to the results of the comparison.

Additionally, the control member 160 drives the printing engine 120 to perform the printing operation and operates the heaters 143 and 144 when the temperature measured in the temperature sensor 150 is lower than the low temperature limit (about 100° C.~250° C.) during the cooling of the oxidation catalyst carrier 146. Thus, the control member 160 compares the temperature measured in the temperature sensor 150 with predetermined reference values and thus controls the interruption of the printing operation and the operations of the heaters 143 and 144 and the fan 141.

The reference values for the high and low temperature limits are predetermined according to the oxidation catalyst used, and a temperature suitable for the oxidation reaction may be obtained through experimentation. Additionally, the temperature sensor 150 may be mounted to an internal center of the oxidation catalyst carrier 146. The temperature sensor 150 is preferably mounted externally of the oxidation catalyst carrier 146 to facilitate mounting. Thus, when the temperature sensor 150 is mounted externally of the oxidation catalyst carrier 146, it calculates a temperature difference between the center and externally of the oxidation catalyst carrier 146 through an experiment. An actual temperature of the oxidation catalyst may be beforehand provided in a form of look-up table from the temperatures measured in the temperature sensor 150. Therefore, a look up table of reference values provided by the experiment may be stored in the memory 170. Additionally, it is possible to update or reset the reference values later according to a use environment and area of the product. Thus, a construction and a method of setting up the reference values are apparent to those skilled in the art and thus their detailed descriptions are omitted.

Additionally, a counter 180 may be further provided to count an interruption time of the printing engine 120, the heaters 143 and 144 and the fan 142. Accordingly, the control member 160 receives information counted in the counter 180 from when the printing operation is interrupted to cool the oxidation catalyst, and judges that the low temperature limit (about 100° C.~250° C.) is reached when the counted time is above a predetermined time, thereby reopening the printing operation. The lookup table of the standard times may be also preset from an experiment and stored in the memory 170.

Hereinafter, a method of controlling the liquid-type image forming apparatus having the above-mentioned structure according to an exemplary embodiment of the present invention is specifically described.

Figure 5:
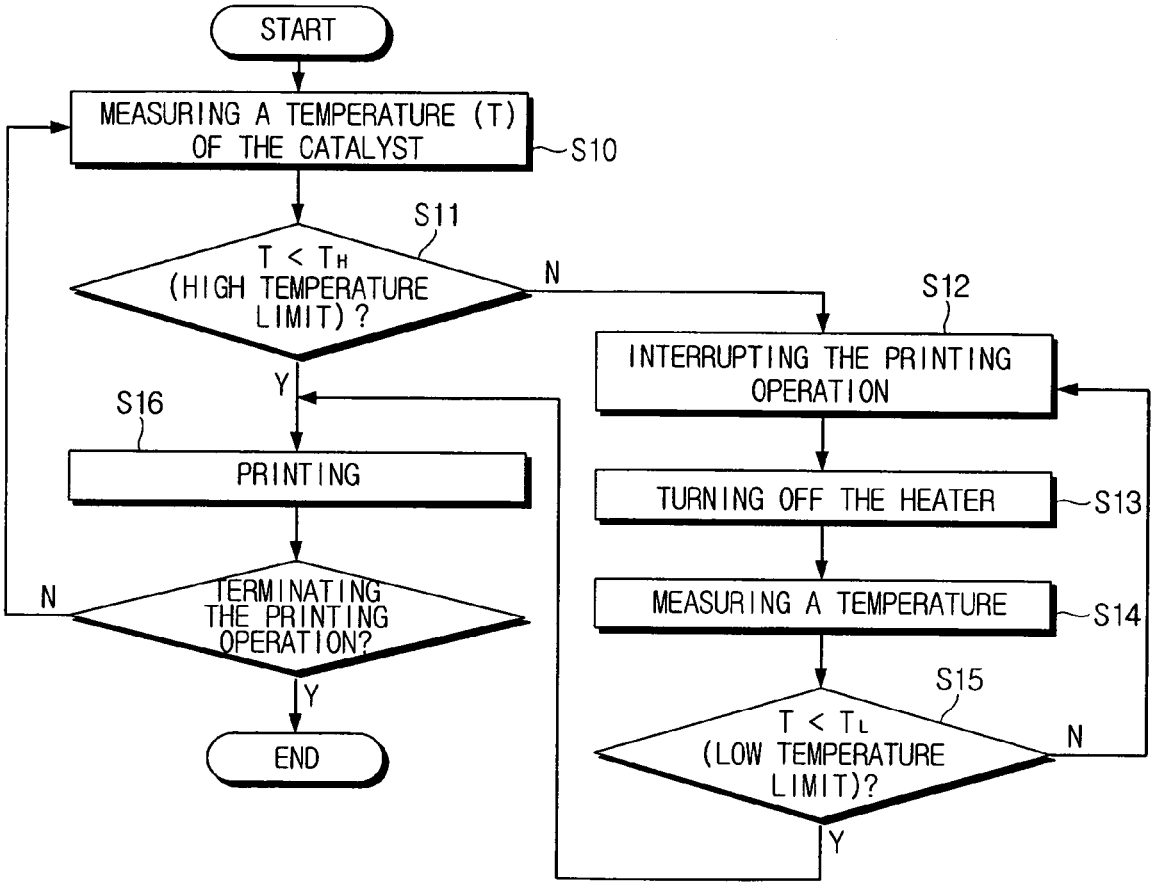
FIG. 5 is a flow chart illustrating a method of controlling a liquid-type image forming apparatus according to an exemplary embodiment of the present invention.

Referring to FIGS. 2, 3 and 5, when a printing operation of the image forming apparatus 100 is started, as shown in FIG. 2, a laser beam from the exposure devices 123*a*, 123*b*, 123*c* and 123*d* is illuminated to the surface of each of the photosensitive drums 121*a*, 121*b*, 121*c* and 121*d*, which are electrified to a predetermined electric potential by the electrification devices 122*a*, 122*b*, 122*c* and 122*d*. Electrostatic latent images are formed on the surfaces of the photosensitive drums 121*a*, 121*b*, 121*c* and 121*d* illuminated with the laser beam as the electrification electric potential of the surface is changed. The developing units 124*a*, 124*b*, 124*c* and 124*d* form visible images by attaching the yellow, magenta, cyan and black developers to the respective electrostatic latent images formed on the photosensitive drums 121*a*, 121*b*, 121*c* and 121*d*. The four colors of visible images formed in this manner are transferred in turn to the transfer belt 126 by the first transfer rollers 127*a*, 127*b*, 127*c* and 127*d*. A color image superposed with the four colors of developers is formed on the transfer belt 126. During a series of the image forming processes, the printing medium P is moved to the transfer belt 126 from the paper supply unit 101. The printing medium P is moved between the transfer belt 126 and the second transfer roller 128, so that the colorful image formed on the transfer belt 126 is transferred to the printing medium P by the second transfer roller 128. Then, the printing medium P is proceeded to the fixing member 130.

The printing medium P moved to the fixing member 130 passes through a space between the heating roller 132 and the press roller 133, exits the fixing member 130, and is discharged to an exterior of the main body 110 through a paper delivery unit (not shown). When the printing medium P passes through a space between the heating roller 132 and the press roller 133, the carrier component of the developer transferred to the printing medium P is evaporated by heat occurred from the heating roller 132, and the ink is fixed to the printing medium P.

In performing such a printing operation, the fan 142 and the heaters 143 and 144 are driven to process the carrier vapors generated from the fixing member 130. Accordingly, the oxidation catalyst of the oxidation catalyst carrier 146 is heated to a temperature suitable for the oxidation and accelerates the oxidation of the carrier vapor.

During the printing operation, the temperature sensor 150 measures a temperature (T) of the oxidation catalyst (S10). The control member 160 receives and compares the measured temperature information from the temperature sensor 150 with a high temperature limit ($T_H$) of the predetermined reference values (S11).

When the measured value compared in the step of S11 exceeds the high temperature limit ($T_H$), the oxidation catalyst carrier 146 is cooled to prevent a damage of the oxidation catalyst. The control member 160 controls the printing engine 120, thereby interrupting the printing operation thereof (S12). When the printing operation of the printing engine 120 is interrupted, the image forming operation is stopped and diverse constituting components idle or are interrupted. Accordingly, the high temperature of carrier vapor is not generated any more from the fixing member 130. Additionally, the control member 160 interrupts the heaters 143 and 144 to stop the heating of the oxidation catalyst carrier 146 (S13).

When the high temperature of carrier vapor does not flow into the fixing member 130, the heating of the oxidation catalyst carrier 146 is interrupted and thus the oxidation catalyst is cooled. Additionally, the control member 160 continues to drive the fan 142 without interrupting it, thereby accelerating the cooling of the oxidation catalyst carrier 146. Thus, the temperature sensor 150 continues to measure the temperature of the oxidation catalyst carrier 146 with the printing operation being interrupted (S14).

The control member 160 checks whether the measured temperature (T) is above the low temperature limit ($T_L$) (S15). Until the measured temperature (T) is above the low temperature limit ($T_L$), the control member interrupts the printing operation so that the oxidation catalyst carrier (T) is cooled. When the measured temperature (T) is below the low temperature limit ($T_L$), the control member 160 repeats the printing operation (S16). That is, the control member 160 controls the printing engine 120 and the heaters 143 and 144 to perform a normal printing operation by driving the printing engine 120 and re-operating the heaters 143 and 144.

As described above, when a temperature of the oxidation catalyst carrier 146 is above the high temperature limit ($T_H$) at which the oxidation catalyst is damaged during the printing operation, the catalyst may be cooled by interrupting the printing operation. Accordingly, it is possible to prevent damage of the oxidation catalyst due to the high temperature. As a result, it is also possible to prolong the lifespan of the oxidation catalyst and to improve an efficiency of the oxidation catalyst.

Addition, when a temperature of the cooled oxidation catalyst is below the low temperature limit ($T_L$), it is possible to control the printing operation to be smoothly proceeded by controlling the printing operation to be restarted.

Meanwhile, in the case shown in FIG. 5, after the printing operation is interrupted (S12), it is possible to quickly proceed the cooling of the oxidation catalyst by turning off the heaters 143 and 144. Alternatively, the printing operation only may be interrupted to inhibit the high temperature of carrier vapor from occurring without turning off the heaters 143 and 144. In this case, it is possible to properly perform the control operation according to an operation condition of the image forming apparatus or a condition required for the oxidation catalyst reaction, etc.

Figure 6:
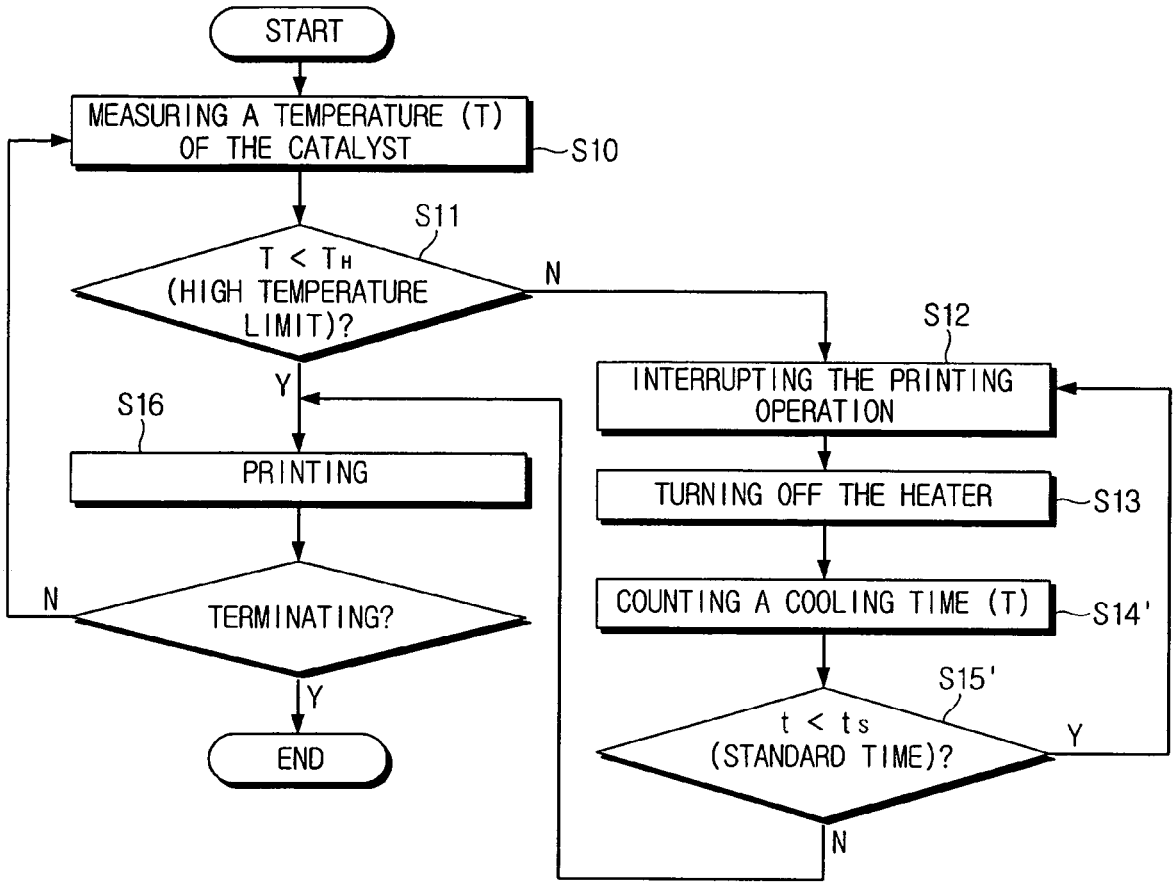
FIG. 6 is a flow chart illustrating a method of controlling a liquid-type image forming apparatus according to another exemplary embodiment of the present invention.

Hereinafter, a method of controlling a liquid-type image forming apparatus according to another exemplary embodiment of the invention is described with reference to FIG. 6.

As shown in the flow chart of FIG. 6, a method of controlling a liquid-type image forming apparatus according to another exemplary embodiment of the present invention performs the same control steps (S10, S12, S14 and S16) as the controlling method described with reference to FIG. 5.

While the oxidation catalyst carrier 146 is cooled by interrupting the printing operation (S12) and turning off the heaters 143 and 144, the counter 180 counts a cooling time (S14'). The counted cooling time (t) is transmitted to the control member 160, and the control member 160 compares the counted cooling time (t) with a preset standard time (ts) (S15'). The control member 160 continues to cool the oxidation catalyst carrier 146 until the cooling time (t) reaches the standard time (ts) or more. The standard time (ts) may be set beforehand and stored in the memory 170 as described above.

When the cooling time (t) becomes the standard time (ts) or more, the control member 160 drives the printing engine 120, turns on the heaters 143 and 144 and thus performs the printing operation again (S16). The standard time (ts) may be set by previously by obtaining a time to reach the low temperature limit ($T_L$) after the step of S12 is started through experimentation. Additionally, it is possible to previously store experimental values according to a use environment and condition of the image forming apparatus in the memory (170) in the form of a lookup table and then to use the stored values.

As described above, according to exemplary embodiments of the present invention, it is possible to previously sense and cool the oxidation catalyst before the oxidation catalyst is damaged by the high temperature. Accordingly, it is possible to prevent the oxidation catalyst from being damaged due to the high temperature, so that the lifespan of the oxidation catalyst may be prolonged.

Additionally, when a temperature of the oxidation catalyst is cooled below the low temperature limit, it is possible to control the printing operation to be re-executed through monitoring of the temperature of the oxidation catalyst, thereby substantially preventing damage of the oxidation catalyst without disturbing the printing operation of the image forming apparatus.

The foregoing embodiments and advantages are merely exemplary and are not to be construed as limiting the present invention. The present teaching may be readily applied to other types of apparatuses. Also, the description of the exemplary embodiments of the present invention is intended to be illustrative, and not to limit the scope of the claims, and many alternatives, modifications, and variations will be apparent to those skilled in the art.

What is claimed is:

1. A liquid-type image forming apparatus having a printing engine including a developing unit and a transfer unit and a fixing member, comprising:

a carrier vapor-processing device having an oxidation catalyst carrier to accelerate oxidation of carrier vapors occurring in the fixing member;

a temperature sensor to detect a temperature of the oxidation catalyst carrier; and a control member to receive information measured by the temperature sensor, to compare the information with predetermined reference values, and to control a printing operation of the printing engine according to the information comparison.

2. The apparatus as claimed in claim 1, wherein the control member interrupts the printing operation of the printing engine when the measured temperature exceeds a maximum value of the reference values during a printing mode.

3. The apparatus as claimed in claim 2, wherein the control member restarts the interrupted printing operation of the printing engine when the measured temperature is below the minimum value of the reference values.

4. The apparatus as claimed in claim 1, wherein a duct of the carrier vapor processing device sucks the carrier vapors from the fixing member;

the oxidation catalyst carrier is mounted in the duct;

a fan is mounted to the duct; and a heater is mounted to the duct to heat the carrier vapors entering the oxidation catalyst carrier.

5. The apparatus as claimed in claim 4, wherein the control member controls an on/off driving of the heater according to the measured temperature of the temperature sensor.

6. The apparatus as claimed in claim 4, wherein the control member controls an on/off driving of the fan according to the measured temperature of the temperature sensor.

7. The apparatus as claimed in claim 4, wherein the heater has first and second heaters disposed within the duct.

8. The apparatus as claimed in claim 7, wherein an optical material is disposed between the first and second heaters within the duct to absorb non-evaporated carrier vapors.

9. The apparatus as claimed in claim 8, wherein the fan is disposed on a first side of the first heater, the oxidation catalyst is disposed on an opposite second side of the second heater, and the optical material is disposed between the first and second heaters.

10. The apparatus as claimed in claim 8, wherein the optical material is zeolite.

11. The apparatus as claimed in claim 4, wherein the control member controls operation of the fan.

12. The apparatus as claimed in claim 1, wherein the temperature sensor is mounted externally of the oxidation catalyst carrier.

* * * * *